US008627536B1

(12) United States Patent
VanDosen

(10) Patent No.: US 8,627,536 B1
(45) Date of Patent: Jan. 14, 2014

(54) SCRATCH-OFF TICKET INK REMOVAL DEVICE

(76) Inventor: Dawn C. VanDosen, Warren, MI (US)

( * ) Notice: Subject to any disclaimer, the term of this patent is extended or adjusted under 35 U.S.C. 154(b) by 351 days.

(21) Appl. No.: 12/977,179

(22) Filed: Dec. 23, 2010

(51) Int. Cl.
*B25F 1/00* (2006.01)

(52) U.S. Cl.
USPC ..... 15/105.51; 15/111

(58) Field of Classification Search
USPC ..... 15/111, 236.05–236.09, 424, 428, 15/105.51–105.53; 30/169; 401/50; 7/118, 7/158
See application file for complete search history.

(56) References Cited

U.S. PATENT DOCUMENTS

| | | | | | |
|---|---|---|---|---|---|
| 96,748 | A | * | 11/1869 | Weeden | 15/105.53 |
| 174,852 | A | * | 3/1876 | Poznanski | 15/105.51 |
| 301,439 | A | * | 7/1884 | Ely | 401/195 |
| 305,173 | A | * | 9/1884 | Gerrish | 401/50 |
| 335,819 | A | * | 2/1886 | Jenkins | 15/105.53 |
| 391,522 | A | * | 10/1888 | Edgarton | 30/456 |
| 408,305 | A | * | 8/1889 | Holmes | 15/105.53 |
| 459,191 | A | * | 9/1891 | Bell | 15/105.53 |
| 501,225 | A | * | 7/1893 | Flake | 30/123 |
| 582,419 | A | * | 5/1897 | Green et al. | 15/105.53 |
| 715,646 | A | * | 12/1902 | Driscoll | 15/105.53 |
| 722,160 | A | * | 3/1903 | Steiger | 401/34 |
| 726,208 | A | * | 4/1903 | Wilson | 15/105.52 |
| 793,520 | A | * | 6/1905 | Hall | 15/105.53 |
| 949,085 | A | * | 2/1910 | McBride | 15/105.53 |
| 1,193,827 | A | * | 8/1916 | Santo | 15/105.53 |
| 1,468,715 | A | * | 9/1923 | Guerrieri | 81/490 |
| 1,525,932 | A | * | 2/1925 | Grunstein | 15/105.53 |
| 1,580,183 | A | * | 4/1926 | Veillette | 15/428 |
| 1,594,342 | A | * | 8/1926 | Alland | 15/105.51 |
| 1,925,388 | A | * | 9/1933 | Hutter | 15/434 |
| 2,144,014 | A | | 1/1939 | Finck | |
| 2,157,450 | A | * | 5/1939 | Cidissen | 15/105.51 |
| 3,051,975 | A | * | 9/1962 | Schwartz | 15/105 |
| 4,205,924 | A | * | 6/1980 | Sumita | 401/65 |
| D290,056 | S | * | 5/1987 | Hatfield | D32/46 |
| 4,757,567 | A | * | 7/1988 | Booker | 15/105 |
| 4,765,842 | A | | 8/1988 | Sanders et al. | |
| D300,087 | S | * | 3/1989 | Henderson | D3/209 |
| 4,827,812 | A | * | 5/1989 | Markovetz | 81/439 |
| 5,355,543 | A | | 10/1994 | Cameron et al. | |
| 5,402,549 | A | | 4/1995 | Forrest | |
| D360,507 | S | * | 7/1995 | Salvato | D32/42 |
| D368,345 | S | * | 3/1996 | Fisher | D32/49 |
| 5,598,604 | A | | 2/1997 | Ho | |
| 5,615,441 | A | * | 4/1997 | Savini | 15/111 |
| 5,713,232 | A | * | 2/1998 | Hodge | 70/456 R |
| 5,857,237 | A | * | 1/1999 | Dranginis | 15/236.02 |
| 5,907,882 | A | | 6/1999 | Tyree | |
| 6,009,590 | A | * | 1/2000 | Stanford | 15/236.07 |
| 8,359,700 | B1 | * | 1/2013 | Zeidan | 15/236.07 |

* cited by examiner

*Primary Examiner* — Lee D Wilson
*Assistant Examiner* — Tyrone V Hall, Jr.
(74) *Attorney, Agent, or Firm* — Montgomery Patent & Design; Robert C. Montgomery

(57) ABSTRACT

A latex ink removal device to aid a user in scratching off instant lottery tickets is herein disclosed, comprising a stylus made of aluminum or a similar durable material that will stand up to tough use as well as allow it to be carried in a pocket or purse. A first end of the device is of a flattened yet curved profile similar to that of a fingernail or edge of a coin. It is used to remove the scratch-off material off of instant lottery tickets. A second end of the device is provided with a replaceable rubber-based eraser that is used to rub off the lighter covering material on some other types of instant lottery tickets such as "Bingo" and "Cashword". Since this eraser material will wear down with use, it is sold as a replaceable part that can simply screw on and off using a threaded connector.

12 Claims, 5 Drawing Sheets

SCRATCH-OFF TICKET INK REMOVAL DEVICE

RELATED APPLICATIONS

The present invention was first described in a notarized Official Record of Invention on Nov. 6, 2008, that is on file at the offices of Montgomery Patent and Design, LLC, the entire disclosures of which are incorporated herein by reference.

FIELD OF THE INVENTION

The present invention relates generally to the field of instant win lottery ticket games, and in particular, to a device adapted for the repeated and expedited removal of common latex ink surfaces and other such surfaces from conventional lottery tickets.

BACKGROUND OF THE INVENTION

Instant-win scratch-off lottery ticket games enjoy widespread popularity among various portions of the population for a number of reasons. Such games are cheap, exciting, easy to understand, simple to gift, and occasionally very profitable. The hidden nature of the game's numbers and possible payouts lend a certain mystery and suspense which provides a great psychological thrill to many persons.

Many such lottery tickets utilize latex ink coatings and other such surfaces as cheap methods of concealing the face of the ticket while allowing the average person to successfully remove the coating without particular stress. A common method of scratching these tickets is to utilize coins, fingernails, keys or other common small objects with suitable edges. However, many of these items which can commonly be found on a person at any given time have curved or small edges which make it difficult to evenly and completely scratch off a surface without the aggravation of extensive repeated scratching.

Various attempts have been made to provide devices which aid a person in the removal of concealing coverings from scratch-off lottery tickets. Examples of these attempts can be seen by reference to several U.S. patents. U.S. Pat. No. 4,765,842, issued in the name of Sanders et al., describes a ticket cleaning apparatus. The Sanders apparatus comprises an electronics housing and a receiving slit with an internal rotating mechanism which drives and scrapes a ticket when inserted in the housing.

U.S. Pat. No. 5,907,882, issued in the name of Tyree, describes a lottery ticket scratch off device. The Tyree device consists of a small housing with a roller and brush which activate upon the pressing of switch to roll a ticket through while removing the ink.

While these devices fulfill their respective, particular objectives, each of these references suffer from one (1) or more of the aforementioned disadvantages. Many such devices are not easily portable. Also, many such devices do not allow for the scratching of tickets in a manner which provides the sought-after thrill of slowly revealing the surface of the ticket. In addition, many such devices are not provided with a soft surface for the soft cleaning of a surface and removal of less vigorous covering. Furthermore, many such devices require power sources in order to operate. Finally, many such devices are not easy to store in a manner of places for quick and easy access during travel. Accordingly, there exists a need for a scratch-off ticket ink removal device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide an assistive device for the scratching of lottery tickets in a manner which is durable, simple, adaptable, portable, and replaceable. Thus, the object of the present invention is to solve the aforementioned disadvantages and provide for this need.

To achieve the above objectives, it is an object of the present invention to comprise a portable scraper which is suitably sized for use with most types of scratch-off lottery tickets which contain a surface portion that is covered by a latex ink substance or the like. The device comprises a body, a scraper, an eraser, a ferrule, and a split ring.

Another object of the present invention is to comprise the body of a generally cylindrical shape molded from high impact synthetic plastic, lightweight metal alloy, or another similar durable material. The scraper is removably attached to a lower end of the body and the eraser to an upper end of the body.

Yet still another object of the present invention is to comprise the scraper of a means of removing ink from the game play surface of a lottery ticket in a normal side to side scraping motion. The ink is typically scraped away, forming an ink residue which may be removed completely via the eraser.

Yet still another object of the present invention is for the body to comprise a threaded shaft on the upper end, a threaded receiver on the lower end, an eye fastener below the threaded shaft, and a split ring attached to the eye fastener.

Yet still another object of the present invention is to comprise the scraper of a threaded shaft, a scraper head, a scraper edge, and two (2) scraper faces made from a similar material as that of the body. The scraper is removably attached to the lower end of the body via the threaded shaft of the scraper and the threaded receiver of the body.

Yet still another object of the present invention is to comprise the eraser of a generally cylindrical shape made from a synthetic rubber material containing vinyl, plastic, gum-like materials, pulverized pumice material, or the like. The eraser is housed with an open end of the ferrule which is crimped to hold the eraser in place. The ferrule further comprises a threaded receiver which is removably attachable to the threaded shaft of the body.

Yet still another object of the present invention is for the two (2) opposing scraper faces to comprise an arcuate concave profile extending from the scraper head perpendicularly. The edge forms a planar surface between the opposing scraper faces in a perpendicular orientation relative to the scraper faces.

Yet still another object of the present invention is to comprise the scraper edge of features such as a scraper ridge and a plurality of scraper grooves in order to enable more efficient ink removal. The scraper ridge comprises a small continuous outward protrusion from the scraper edge around the outer perimeter of each scraper face. The plurality of scraper grooves comprises a plurality of small indentations equally spaced along a lower curved planar end of the scraper edge perpendicular to the scraper faces.

Yet still another object of the present invention is to comprise the split ring of a single piece of metal in a double-loop configuration in which both ends can be pried open to allow the insertion of a desired attaching article in a conventional spiral manner. In use, a user removably attaches the split ring to various articles as desired, such as keys, a clip, a pant loop, a wrist band, or the like.

Yet still another object of the present invention is to provide a method of utilizing the device that provides a unique means of easily storing, securing and transporting the device, removing the ink covering from a conventional lottery ticket in a comfortable, controlled, and quick manner, utilizing the eraser to provide a final cleaning of the ticket surface, and allowing a user to replace the eraser and scraping edge after extensive use or damage.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
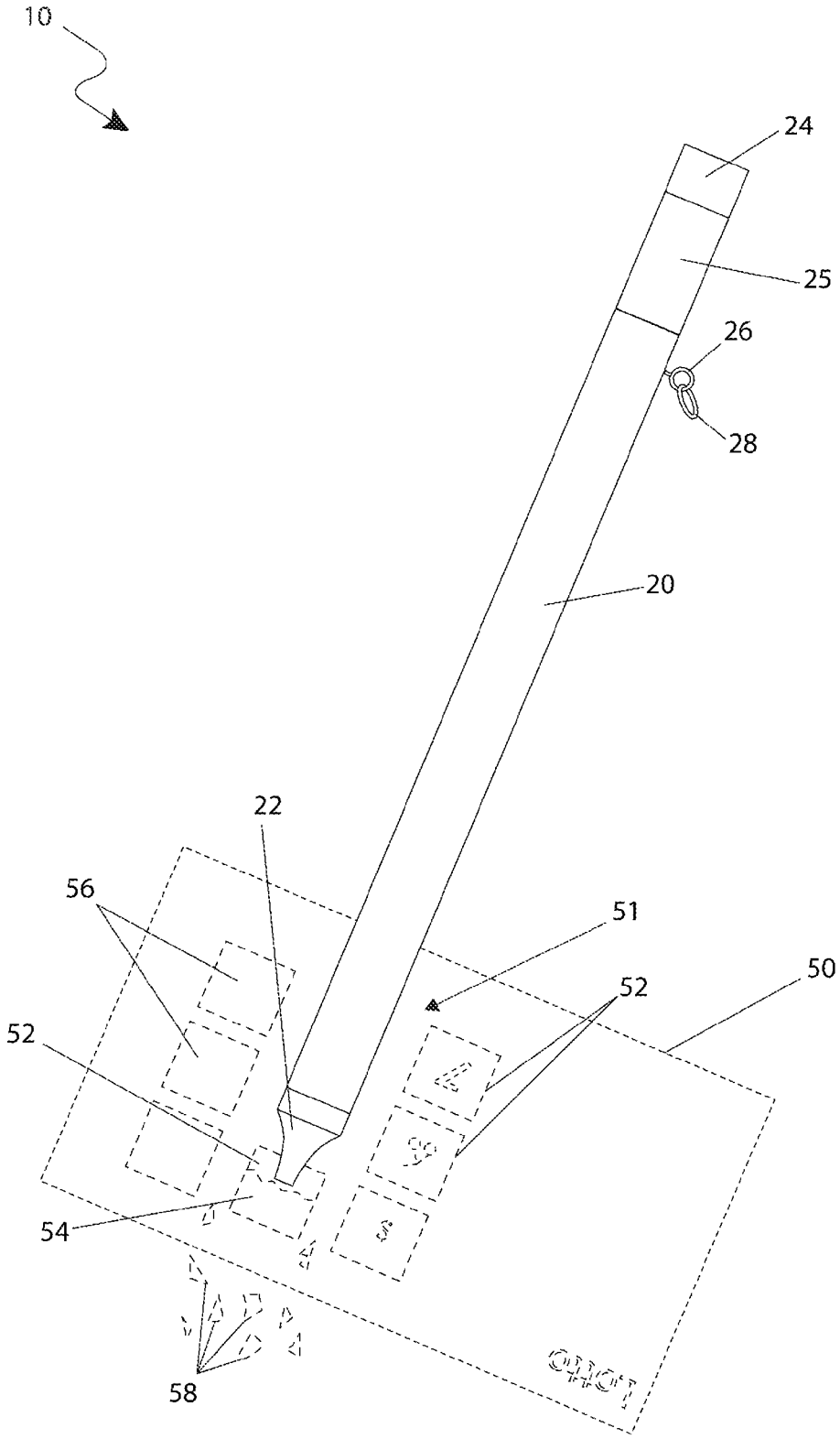
FIG. 1 is an environmental view of a scratch-off ticket ink removing device 10, according to a preferred embodiment of the present invention.

| | |
|---|---|
| 10 | scratch-off ticket ink removing device |
| 20 | body |
| 22 | scraper |
| 24 | eraser |
| 25 | ferrule |
| 26 | eye fastener |
| 28 | split ring |
| 30a | first threaded shaft |
| 30b | second threaded shaft |
| 32 | threaded receiver |
| 34 | scraper head |
| 36 | scraper edge |
| 38 | scraper face |
| 40 | scraper ridge |
| 42 | scraper grooves |
| 50 | scratch-off ticket |
| 51 | game play surface |
| 52 | exposed area |
| 54 | scratchable area |
| 56 | ink |
| 58 | ink residue |
| 60 | user |
| 65 | lanyard |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a scratch-off ticket ink removing device (herein described as the "device") 10, which provides a means for easily and conveniently manually removing an amount of covering ink 56 therefrom a game play surface 51 of a scratch-off ticket 50. The device comprises a body 20, a scraper 22, an eraser 24, a ferrule 25, and a split ring 28. The device provides a portable scraper 22 which is suitably sized for use with most types of scratch off lottery tickets 50, instant game cards, or the like.

Referring now to FIG. 1, an environmental view of the device 10, according to the preferred embodiment of the present invention, is disclosed. The device 10 is illustrated in an in use state depicting the removal of the covering ink 56 from the entire scratchable area 54 of the ticket 50. The device 10 is preferably utilized with a standard scratch card type game piece, such as a scratch-off lottery ticket 50, instant game piece, or any similar article which contains a surface portion that is covered by a latex ink 56 substance, which cannot be seen through, commonly used to conceal said surface portion.

The device 10 comprises the body 20 to which the scraper 22 is removably attached thereto a lower end thereof and the eraser 24 is removably attached thereto an upper end thereof. The body 20 comprises a generally cylindrical shape which is molded from high impact synthetic plastic, a light weight metal alloy, or the like and is preferably four (4) to five (5) inches long and one-quarter (¼) inch in diameter. The body 20 is coated with any variation of colors, designs, or other aesthetic decorations. The scraper 22 provides a means of removing a desired amount of ink 56 therefrom the game play surface 51 in a normal back and forth or side to side scraping motion. The ink 56 is typically scraped away forming an ink residue 58 which is then completely removed and cleaned therefrom a now ink 56 free and exposed area 52 via the eraser 24.

Figure 2:
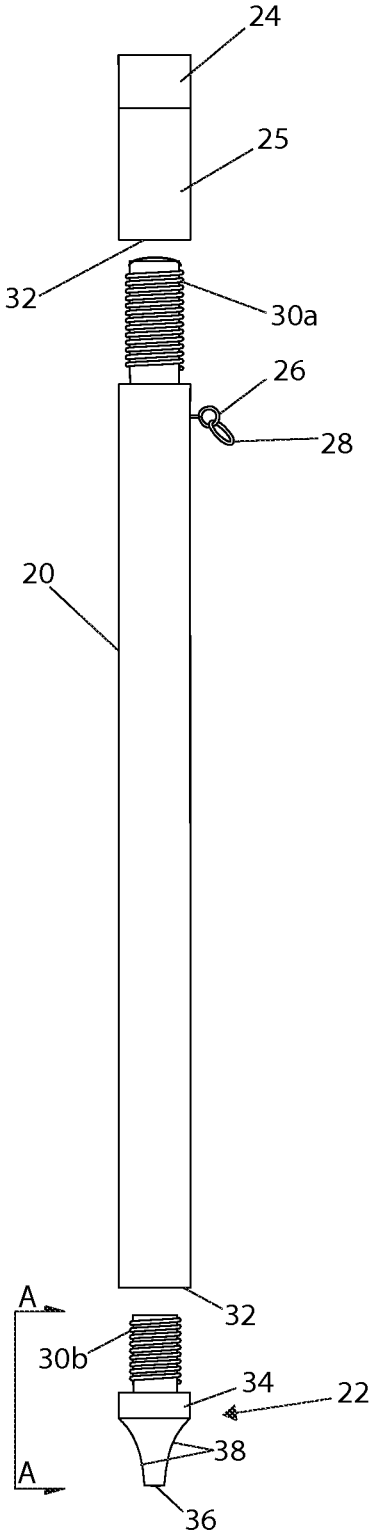
FIG. 2 is an exploded view of the scratch-off ticket ink removing device 10, according to a preferred embodiment of the present invention.

Referring now to FIG. 2, an exploded view of the device 10, according to the preferred embodiment of the present invention, is disclosed. The body 20 comprises a first threaded shaft **30*a* thereon the upper end, a threaded receiver 32 thereon the lower end, an eye fastener 26 therebelow said threaded shaft 26 thereon said upper end, and a split ring 28 that is attached thereto said eye fastener 26. The scraper 22 comprises a second threaded shaft 30*b*, a scraper head 34, a scraper edge 36, and two (2) scraper faces 38. The scraper 22 is made from a similar durable, rigid material as that of the body 20 and is threadingly attached thereto the lower end of said body 20 via the second threaded shaft 30*b* which is inserted thereinto the threaded receiver 32 of said body 20. The eraser 24 comprises a generally cylindrical shape approximately one-half (½) an inch long and one-quarter (¼) inch in diameter and is made from a synthetic rubber material containing vinyl, plastic, or gum-like materials which is blended with a pulverized pumice material to make it slightly abrasive. The eraser 24 is housed within an open end of a ferrule 25 which is crimped to hold said eraser 24 in place. The ferrule comprises a threaded receiver 32 located thereon a lower end which threadingly attaches thereto the first threaded shaft 30***a* thereon the upper end of the body 20. The scraper 22 and the eraser 24 can be removed, discarded, and replaced as needed due to damage or wear.

Figure 3:
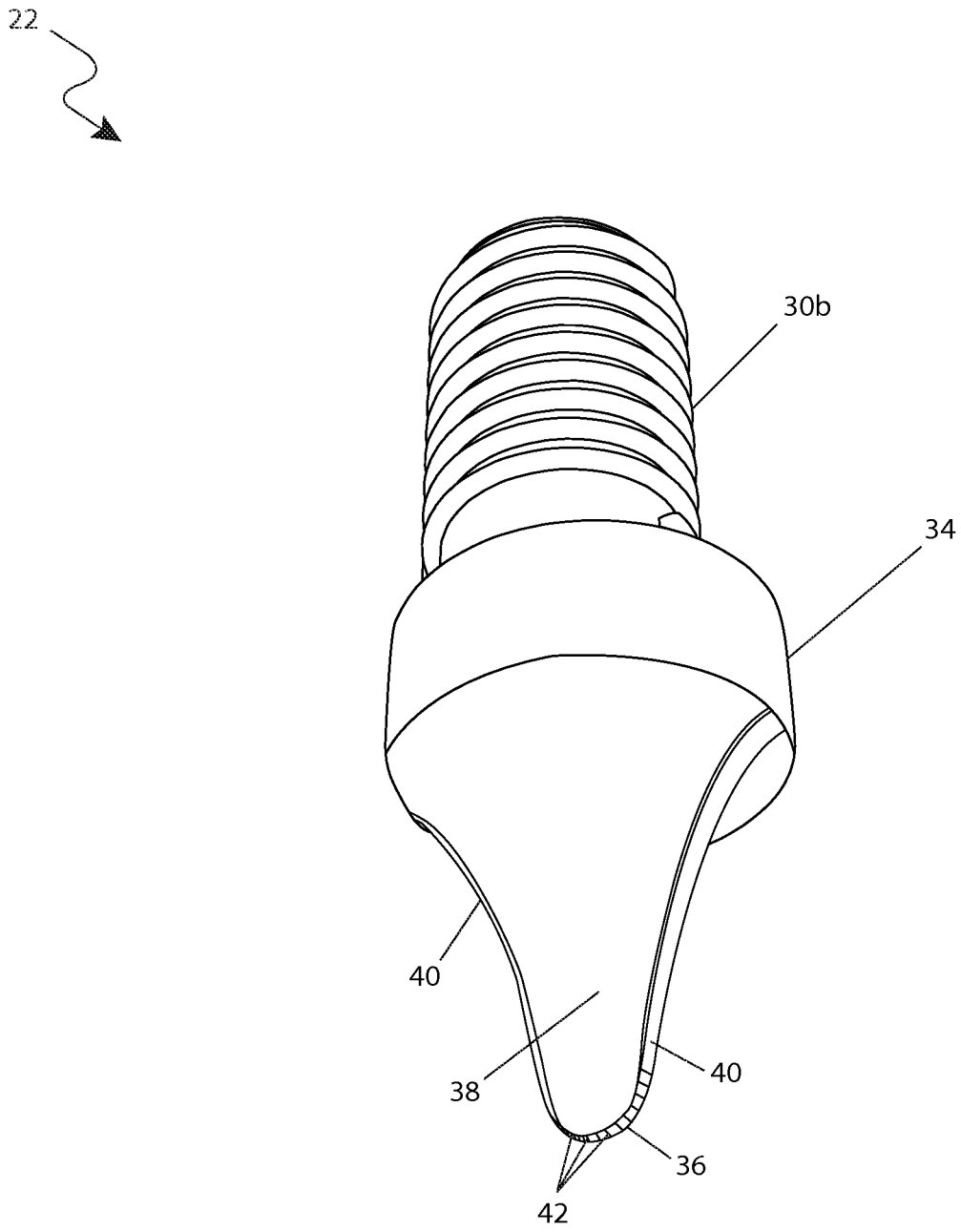
FIG. 3 is an enlarged view of a scraper 22, according to a preferred embodiment of the present invention.
Figure 4:
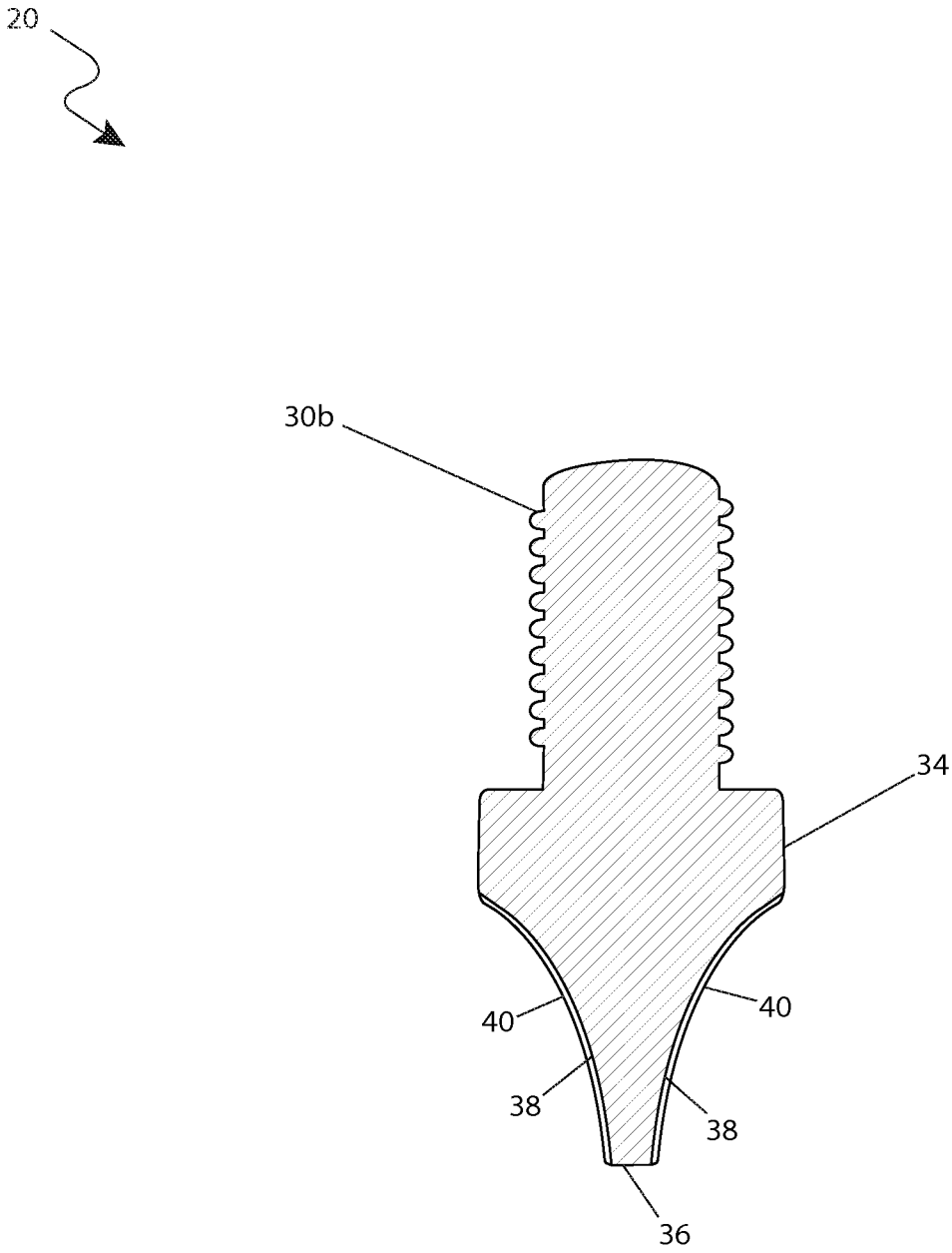
FIG. 4 is a section view taken along section line A-A of the scraper 22, according to a preferred embodiment of the present invention; and, FIG. 5 is an environmental view of the scratch-off ticket ink removing device 10, according to a preferred embodiment of the present invention.

Referring now to FIGS. 3 and 4, an enlarged view and a section view taken along section line A-A respectively, of the scraper 22, according to the preferred embodiment of the present invention, is disclosed. The scraper head 34 comprises a generally circular shape having an approximate thickness of one-sixteenth (1/16) of an inch with a planar top surface to which the second threaded shaft 30*b* protrudes upwardly. The two (2) opposing scraper faces 38 comprise an arcuate concave profile extending therefrom a bottom planar surface of the scraper head 34 terminating in a perpendicular orientation relative to the bottom surface of said scraper head 34. The scraper edge 36 forms a planar surface therebetween the opposing scraper faces 38 in a perpendicular orientation relative to said scraper faces 38. The scraper edge 36 comprises special features which enable more efficient ink 56 removal including, a scraper ridge 40 and a plurality of scraper grooves 42. The scraper ridge 40 comprises a small continuous outward protrusion therefrom the scraper edge 36 therearound the outer perimeter of each scraper face 38. The scraper grooves 42 comprise a plurality of small indentions equally spaced therealong a lower curved planer end of the scraper edge 36 perpendicular thereto the scraper faces 38.

Figure 5:
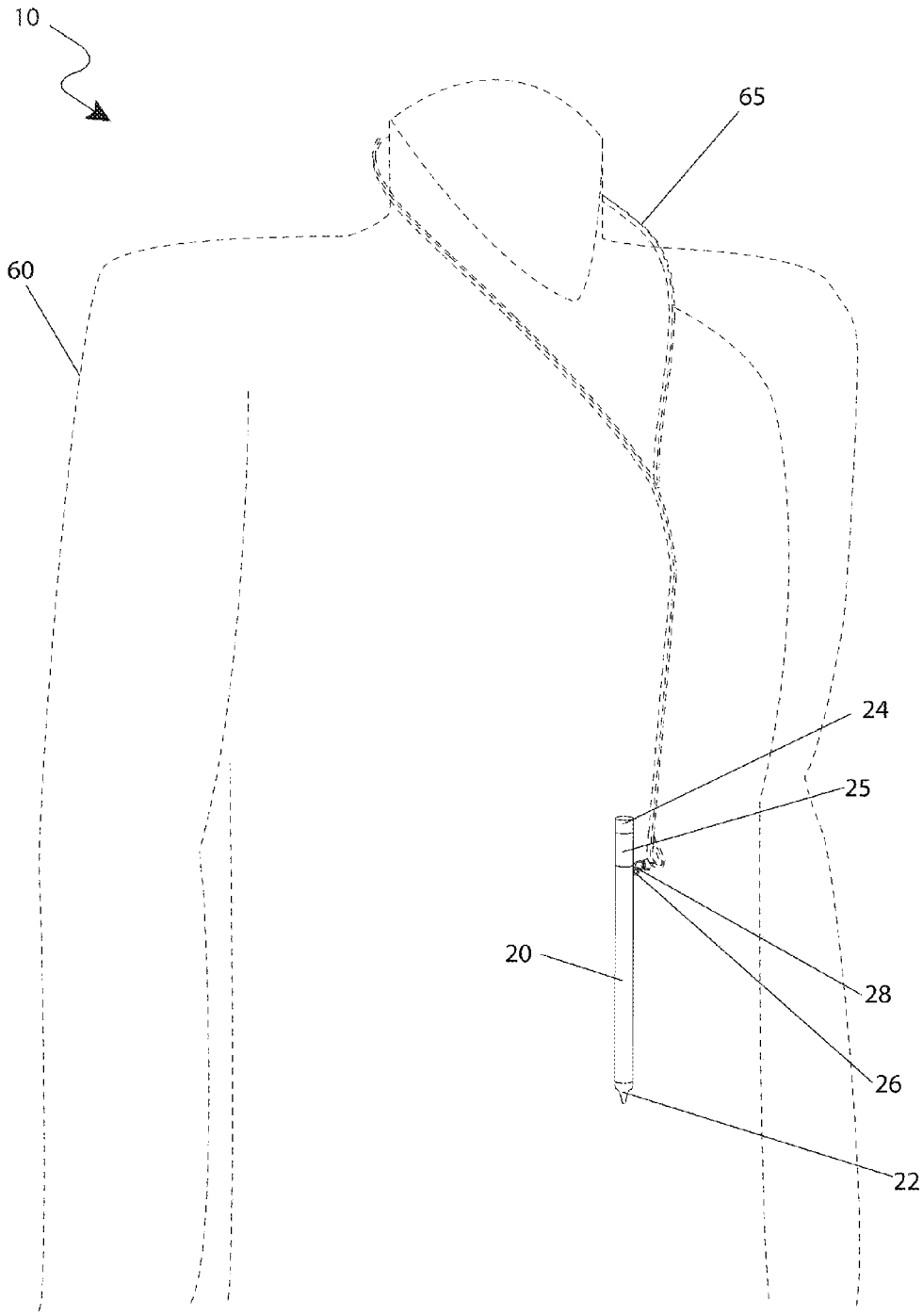

Referring now to FIG. 5, an environmental view of the device 10, according to the preferred embodiment of the present invention, is disclosed. The device 10 is easily carried on the person of a user 60 either in a pocket or by attaching said device 10 via the slit ring 28. The device 10 is illustrated here as attached thereto a common neck lanyard 65. The split ring 65 can be removably attached thereto various other article as desired by the user 60, such as keys, a clip, a pant loop, a wrist band, or the like. The split ring 28 comprises a single piece of metal in a double loop orientation in which either end can be pried open to allow the insertion of a desired attaching article and slid along the spiral until it become wholly engaged within said split ring 28.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be assembled as indicated in FIG. 2 and utilized as indicated in FIG. 1.

The method of utilizing the device 10 may be achieved by performing the following steps: retrieving any number of scratch-off tickets 50 or similar game piece; retrieving said device 10; gripping a cylindrical body portion 20 with a scraper 22 superjacent to a game play surface 51; engaging a scraper edge 36 thereto a scratchable area 54; scraping ink 56 therefrom said scratchable area 54 in a conventional manner until an adequate area of said game play surface 51 becomes an exposed surface 52; rotating said device 10 one hundred eighty degrees (180°), thereby positioning an eraser 24 superjacent to said exposed area 52; rubbing said eraser 24 over said exposed area 52 thereby cleaning any excess ink 56 therefrom said exposed area 52; brushing away any excess ink residue 58; continuing as needed to expose a desired amount of said game play surface 51.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An ink removing device, comprising a body having a scraper removably attached to a first end, and an eraser removably attached to a second end;

wherein said body comprises a generally cylindrical shape with a first receiver at said first end and a first fastener at said second end;

wherein said scraper is removably attached to said first receiver; and, wherein said eraser is removably attached to said first fastener and further comprises:

a ferrule, comprising an outer diameter coterminous with said body, having a second receiver at a first end and an open second end; and, an eraser body, comprising an outer diameter coterminous with said ferrule and securably fastened within said open second end of said ferrule;

wherein a user utilizes said ink removing device to remove ink from a substrate;

wherein said user directs said scraper against said ink to forcibly remove said ink from said substrate into ink residue; and, wherein said user directs said eraser against said substrate to remove said ink residue.

2. The ink removing device of claim 1, wherein said body comprises a molded construction comprising a high impact synthetic plastic or a lightweight metal alloy.

3. The ink removing device of claim 1, further comprising a suspending means attached to an outer surface of said body.

4. The ink removing device of claim 3, wherein said suspending means further comprises an eye fastener adjacent to said first fastener and a split ring attached to said eye fastener.

5. The ink removing device of claim 1, wherein scraper further comprises:

a scraper head, comprising a planar first surface comprising an outer diameter coterminous with said body and a planar second surface;

a second fastener extending outwardly from said planar first surface; and, a pair of scraper faces each comprising an arcuate concave surface extending outwardly from said planar second surface and terminating at a scraper edge.

6. The ink removing device of claim 5, wherein said scraper edge further comprises a scraper ridge and a plurality of scraper grooves;

wherein said scraper ridge and said plurality of scraper grooves provide an enhanced scraping means to remove said ink from said substrate.

7. The ink removing device of claim 1, wherein said eraser body further comprises a synthetic rubber material blended with a pulverized pumice material.

8. An ink removing device, comprising:

a body, comprising a generally cylindrical shape with a first threaded receiver at a first end and a first threaded shaft at a second end;

a scraper removably attached to said first end of said body, further comprising:

a scraper head, comprising a planar first surface comprising an outer diameter coterminous with said body and a planar second surface;

a second threaded shaft extending outwardly from said planar first surface; and, a pair of scraper faces each comprising an arcuate concave surface extending outwardly from said planar second surface and terminating at a scraper edge, said scraper edge further having a scraper ridge and a plurality of scraper grooves; and, an eraser removably attached to said second end of said body, further comprising:

a ferrule, comprising an outer diameter coterminous with said body, having a second threaded receiver at a first end and an open second end; and, an eraser body, comprising an outer diameter coterminous with said ferrule and securably fastened within said open second end of said ferrule;

wherein a user utilizes said ink removing device to remove ink from a substrate;

wherein said user directs said scraper edge against said ink to forcibly remove said ink from said substrate into ink residue; and, wherein said user directs said eraser body against said substrate to remove said ink residue.

9. The ink removing device of claim 8, further comprising a suspending means attached to an outer surface of said body.

10. The ink removing device of claim 9, wherein said suspending means further comprises an eye fastener adjacent to said first fastener and a split ring attached to said eye fastener.

11. The ink removing device of claim 10, wherein said body comprises a molded shape comprising a high impact synthetic plastic or a lightweight metal alloy.

12. The ink removing device of claim 10, wherein said eraser body further comprises a synthetic rubber material blended with a pulverized pumice material.

* * * * *